US005823175A

United States Patent [19]

Sweitzer et al.

[11] Patent Number: 5,823,175

[45] Date of Patent: Oct. 20, 1998

[54] THERMAL PROTECTIVE BARRIER

[76] Inventors: Bruce K. Sweitzer; Barbara E. Sweitzer, both of 2145 North Glade Rd., Swanton, Md. 21561

[21] Appl. No.: 579,626

[22] Filed: Dec. 26, 1995

[51] Int. Cl.[6] ..... F24C 15/34; F24C 15/36

[52] U.S. Cl. ..... 126/34; 126/31; 126/201; 126/279; 165/170; 122/20 A; 122/20 B

[58] Field of Search ..... 126/34, 31, 201, 126/500, 279; 165/901, 80.1, 80.5, 154, 170, 169, 168; 122/20 R, 20 A, 20 B

[56] References Cited

U.S. PATENT DOCUMENTS

| | | | |
|---|---|---|---|
| 302,913 | 8/1884 | Kirk | 122/20 A |
| 515,640 | 2/1894 | Austin | 122/20 B |
| 704,009 | 7/1902 | Ebersole | 122/20 B |
| 842,658 | 1/1907 | Haskell | 126/674 |
| 1,025,368 | 5/1912 | Chambers | 122/20 A |
| 1,095,720 | 5/1914 | Fermer . | |
| 1,118,656 | 11/1914 | Labedzki | 126/5 |
| 1,461,349 | 7/1923 | Hopfenthaler et al. | 122/20 A |
| 1,553,107 | 9/1925 | Reeves | 126/5 |
| 2,080,229 | 5/1937 | Ray . | |
| 2,266,134 | 12/1941 | Wachowitz | 165/169 |
| 4,148,302 | 4/1979 | Patterson . | |
| 4,334,518 | 6/1982 | Ort . | |
| 4,335,703 | 6/1982 | Klank . | |
| 4,337,894 | 7/1982 | Shupe . | |
| 4,384,566 | 5/1983 | Smith . | |
| 4,392,455 | 7/1983 | Jarvis . | |
| 4,399,805 | 8/1983 | Kienlen . | |
| 4,403,573 | 9/1983 | Cauchy . | |
| 4,411,252 | 10/1983 | Funkhouser . | |
| 4,438,755 | 3/1984 | Moffett . | |
| 4,455,970 | 6/1984 | Lyman | 122/20 B |

FOREIGN PATENT DOCUMENTS

| | | | |
|---|---|---|---|
| 237974 | 10/1959 | Australia | 165/170 |
| 513859 | 2/1921 | France . | |
| 595603 | 10/1925 | France | 126/365 |
| 348844 | 4/1970 | U.S.S.R. | 165/169 |
| 27784 | 12/1903 | United Kingdom | 126/34 |
| 2031577 | 4/1980 | United Kingdom . | |

*Primary Examiner*—Carl D. Price
*Attorney, Agent, or Firm*—Richard C. Litman

[57] ABSTRACT

A thermal protective barrier is provided for space heating units in the form of a relatively thin panel having an interior volume filled with a non-combustible liquid (water and/or antifreeze mix, etc.). Two of the embodiments are flat and are adapted to be placed beneath and about the sides of a stove or other heating unit, with a third embodiment having a toroidal cross section and being adapted for installation about the flue of such a stove or heater. Additional structure may be installed within the panels to provide additional support, as required. The panels may be removably installed between the stove and adjacent walls and the underlying floor, or may be permanently installed integrally with the building structure. The panels may also include decorative coverings for exposed surfaces, if desired. The panels may be independent of other water or fluid systems, or may be interconnected with a water heater or hot water heating system, if desired. Temperature or pressure relief valves may also be incorporated in the event of superheating of the liquid within the panels.

5 Claims, 4 Drawing Sheets

THERMAL PROTECTIVE BARRIER

FIELD OF THE INVENTION

The present invention relates generally to panels used to insulate or protect underlying structures from excessive heat, and more specifically to various thermal barriers containing a thermally protective fluid (water or other heat exchange medium, etc.) therein. The barriers are installed about a stove, space heater, or other interior heating units, to protect the floor and walls from excessive heat which may emanate from the heating unit and/or flue.

BACKGROUND OF THE INVENTION

Many persons have installed space heaters, Franklin or other wood burning stoves, or the like, in their homes and other structures. Such heating units serve to supplement other heating systems, and may be used to burn otherwise discarded materials, such as waste oil or paper. In fact, many persons have installed such units as the primary or only source of heat in a small cabin, summer home, or other building structure not intended as a primary residence. In many cases, the user not only desires a functional heating unit, but also wishes to enjoy the nostalgic appearance of an older cast iron stove or the like.

Of course, such heaters or stoves get extremely hot, as they radiate and connect sufficient heat to warm the room in which they are installed, or perhaps even the entire interior of a smaller structure. While some of these units may be placed in the center of a room, in order to distribute the heat evenly throughout the room, in many cases such heaters are installed close to a wall or corner of the room in order to maximize the space in the room. This can often result in the extreme heating of adjacent walls and/or the underlying floor structure, depending upon the heat output of the unit and other considerations.

Accordingly, it is known to install a firebrick or other masonry underlay beneath such heating units, and/or to install asbestos or other insulated panels between the stove and the surrounding wall structure. However, brick and stone work are quite heavy, and in combination with the weight of a cast iron stove, can result in considerable floor loading. Asbestos is generally not considered a viable alternative, due to its environmental hazard. Moreover, such solid materials do nothing to limit the heat developed from an overheated stove or the like, and will continue to transmit heat, possibly to the ignition point of the underlying structure, if they are heated sufficiently.

Accordingly, a need will be seen for a thermal protective barrier which relies upon the principle of a water or other incombustible fluid container which is used to enclose at least partially, a stove or other space heating unit installed within an enclosed area. The barrier generally comprises a rigid container filled with water or other suitable fluid, and which may be in the form of an underlayment for the stove, a wall panel installable between stove and adjacent wall, and/or a toroidal cross section unit adapted to surround the flue of the stove. The barrier in its various embodiments may be installed integrally in the structure, or with the stove or heating unit, or may be installed as an overlay between the floor and walls of the structure and the stove. The barrier may also take advantage of the heat absorbed thereby, and used to provide some of the heat required of a hot water heating system.

DESCRIPTION OF THE PRIOR ART

U.S. Pat. No. 4,148,302 issued to Tommy W. Patterson on Apr. 10, 1979 describes a Thermal Flue Apparatus comprising a semicircular section shield which surrounds half the diameter of a cylindrical flue. The device includes an interior volume, but the volume is open to the environment and cannot contain a liquid therein. In fact, the Patterson device is intended to allow air flow through the volume, from the open bottom to the open top as the air is heated convectively therein. While the present barriers may also provide for convective heating of the fluid therein, each unit is completely closed and does not communicate with the air in the room.

U.S. Pat. No. 4,334,518 issued to Sterling L. Ort on Jun. 15, 1982 describes a Heating System including an enclosure about the sides and rear of a fireplace or the like. The enclosure includes a serpentine fluid channel therein, with the channel being protected from direct exposure to combustion heat by the enclosure. The Ort system does little to preclude thermal heat transfer to structures opposite the combustion site, as the fluid containment channels are discontinuous and do not provide a continuous, unbroken fluid volume between the combustion site and any adjacent structure, as accomplished by the present invention. In fact, Ort indicates that it is preferred that the fluid channels not be in direct contact with the surrounding enclosure, in order to allow air to circulate therebetween. (Col. 3, lines 35–39.) Ort does not provide thermal protection for the chimney or flue, nor does he provide any thermal protection or heat exchange beneath the fireplace or combustion site, as provided by the present invention.

U.S. Pat. No. 4,335,703 issued to Benno E. O. Klank on Jun. 22, 1982 describes a Heat Conservation And Storage Apparatus And System, comprising a shell through which air may flow and a plurality of liquid heat exchange medium pipes passing therethrough. The resulting structure is more closely related to the Ort device described immediately above, than to the continuous liquid barrier embodiments of the present invention. While these devices may be reasonably efficient in terms of heat transfer, they do little to protect the structure opposite the combustion site. This is clear from a review of the Ort and Klank disclosures, wherein the devices are described as being installed in a fireplace or the like, rather than taking the place of the fireplace. Each must rely upon the thermally protective structure of the existing fireplace (fire bricks, etc.) rather than providing sufficient thermal protection on their own.

U.S. Pat. No. 4,337,894 issued to James T. Shupe on Jul. 6, 1982 describes a Wall Protective Heating System comprising a series of air ducts. At least one of the ducts is a relatively thin, flat configuration positioned immediately between the stove and adjacent wall. This duct communicates with other duct work in the floor and ceiling to provide for circulation of air. The device requires an active air transfer means (fan, etc.), as the lower end of the duct is connected to the cold air return line to an existing central heating unit. Thus, the air must be forced to flow downward through the duct, rather than rising in the duct due to natural convection. No liquid is provided by Shupe with his device, and little thermal protection would be achieved by the thin metal walls and air space of the duct adjacent the stove and wall.

U.S. Pat. No. 4,384,566 issued to Rodney I. Smith on May 24, 1983 describes a Prefabricated Fireplace including a double walled box providing for air circulation therethrough. The principle of operation is essentially the same as that of the prior art discussed above. Smith realizes that the thermal protection provided by such a thin walled box having air circulating therethrough is minimal at best, and accordingly provides a thick outer concrete shell surrounding the double walled metal air box. The use of such a concrete structural material precludes any portability or removability of the structure, which is permanently installed. While the present thermally protective barrier embodiments may also be permanently installed, they may also be temporarily and removably installed, e. g., around and beneath a cast iron stove or the like, if desired.

U.S. Pat. No. 4,392,455 issued to Raymond C. Jarvis on Jul. 12, 1983 describes a Heat-Sink Water Heater, having a generally U-shaped water pipe which may be secured to the side of a stove or the like. The two ends of the U communicate with the inlet and outlet sides of a conventional hot water heater. The device does not provide a continuous water barrier between the stove and adjacent surfaces or space, as provided by the present invention. Jarvis has no intention of providing thermal protection or safety, but rather is interested only in providing some supplemental preheating of water prior to its being heated in the hot water heater. While the present invention may also be used to provide a similar function, this is more an auxiliary function than a primary purpose, with the structure of the present thermally protective barrier being primarily directed to providing a heat barrier than to acting as a truly efficient heat transfer device.

U.S. Pat. No. 4,399,805 issued to Loren C. Kienlen et al. on Aug. 23, 1983 describes a Panel Insulation Apparatus comprising a thin, double walled sheet metal duct which is secured to the wall behind a stove or the like. The device communicates with the room air at both the lower and upper ends, thereby convectively channeling air through the duct as the duct is heated by the stove. Kienlen et al. state that the device provides thermal insulation, but as the oxygen within the air serves to support combustion, and room air is circulating through the device, it would appear that little protection is provided. The present invention provides true thermal protection by means of the water or other liquid therein which does not support combustion, and which in extreme cases may limit the maximum heat retained therein by changing state (i. e., liquid to gas by boiling) to absorb further heat.

U.S. Pat. No. 4,403,573 issued to Charles J. Cauchy on Sep. 13, 1983 describes a Water Heating Apparatus For Solid Fuel Firebox, comprising a sinusoidally curved water tube which is secured to the side of the firebox and connected to a water heater. The device is more similar to that of the Jarvis patent discussed further above, than to the present invention. Cauchy does not disclose any means of protecting any adjacent structure or space from excessive heating, as is the primary function of the present thermally protective barrier embodiments. Again, the present barriers may be connected to a water heater or hot water heating system, but such function is a secondary purpose of the present invention, beyond the primary purpose of thermally protecting the adjacent environment.

U.S. Pat. No. 4,411,252 issued to Berland M. Funkhouser on Oct. 25, 1983 describes a Wall Protector And Heat Circulator comprising a perforated duct using forced air circulation therethrough. The duct is placed between a stove or the like and an adjacent wall, and ambient air is blown through the duct to exit the perforations. No water or other liquid heat exchange or thermal protective medium, is disclosed by Funkhouser, and the device does not substantially surround or enclose any portion of the stove or heater, as provided by the present apparatus.

U.S. Pat. No. 4,438,755 issued to Daniel J. Moffett on Mar. 27, 1984 describes a Wood Burning Stove Having Water Heater, wherein the back of the stove includes an open water reservoir which communicates with the ambient air to provide humidifying thereof. A set of water tubes runs through the open water reservoir, to absorb heat from the reservoir prior to flowing to a water heater or other hot water system or supply. The water reservoir is located on only the rear surface of the heater, and does nothing to protect the underlying structure or other surfaces. The system would require regular replenishment of the water in the open reservoir, unlike the closed system of the present invention. The only closed portion of the Moffett stove is the sinusoidal water tube passing through the open water reservoir, unlike the continuous interior volume of the present thermal barrier devices.

French Patent Publication No. 513,859 to Louis Barrier and published on Feb. 25, 1921 describes a heater or stove including various air inlet and exhaust baffles therein. No insulating or thermally protective characteristics appear to be disclosed, nor is any liquid circulation or insulation provided, as with the present invention.

Finally, British Patent Publication No. 2,031,577 to Charles E. Johnson and published on Apr. 23, 1980 describes an Insulated Heat Shield And Convective Unit, comprising a sheet of foam plastic insulation which is secured to a wall behind a radiator or heating unit. Another sheet of heat absorbing material is spaced apart from the insulation by an air gap therebetween. No liquid filled protective barrier is disclosed, as provided by the present invention.

None of the above noted patents, taken either singly or in combination, are seen to disclose the specific arrangement of concepts disclosed by the present invention.

SUMMARY OF THE INVENTION

By the present invention, an improved thermal protective barrier is disclosed.

Accordingly, one of the objects of the present invention is to provide an improved thermal protective barrier which comprises at least one panel having an enclosed volume filled with a non-combustible liquid, which liquid provides insulation and thermal protection for any structure there behind when the panel is placed between a heating unit and other structure.

Another of the objects of the present invention is to provide an improved thermal protective barrier which includes sufficient internal reinforcement to provide support for a heating unit placed thereon, and to act as a thermally insulating barrier between the heating unit and the underlying floor.

Yet another of the objects of the present invention is to provide an improved thermal protective barrier which may include means to interconnect the barrier and liquid therein, with a hot water heating system or with a water heater.

Still another of the objects of the present invention is to provide an improved thermal protective barrier which may include pressure or temperature relief means to provide for the release of superheated liquid within the barrier, in the event of excessive heat absorption.

A further object of the present invention is to provide an improved thermal protective barrier which may comprise floor and/or wall panels, and/or may be formed to have a toroidal cross section to surround a heater flue pipe or the like.

An additional object of the present invention is to provide an improved thermal protective barrier which may be installed temporarily as a portable and removable unit, or which may be permanently installed integrally with the building structure, as desired, and which may include decorative coatings or the like on any exposed surfaces thereof.

A final object of the present invention is to provide an improved thermal protective barrier for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the figures of the attached drawings.

DETAILED DESCRIPTION OF THE PREFERRED EMBODIMENTS

Figure 1:
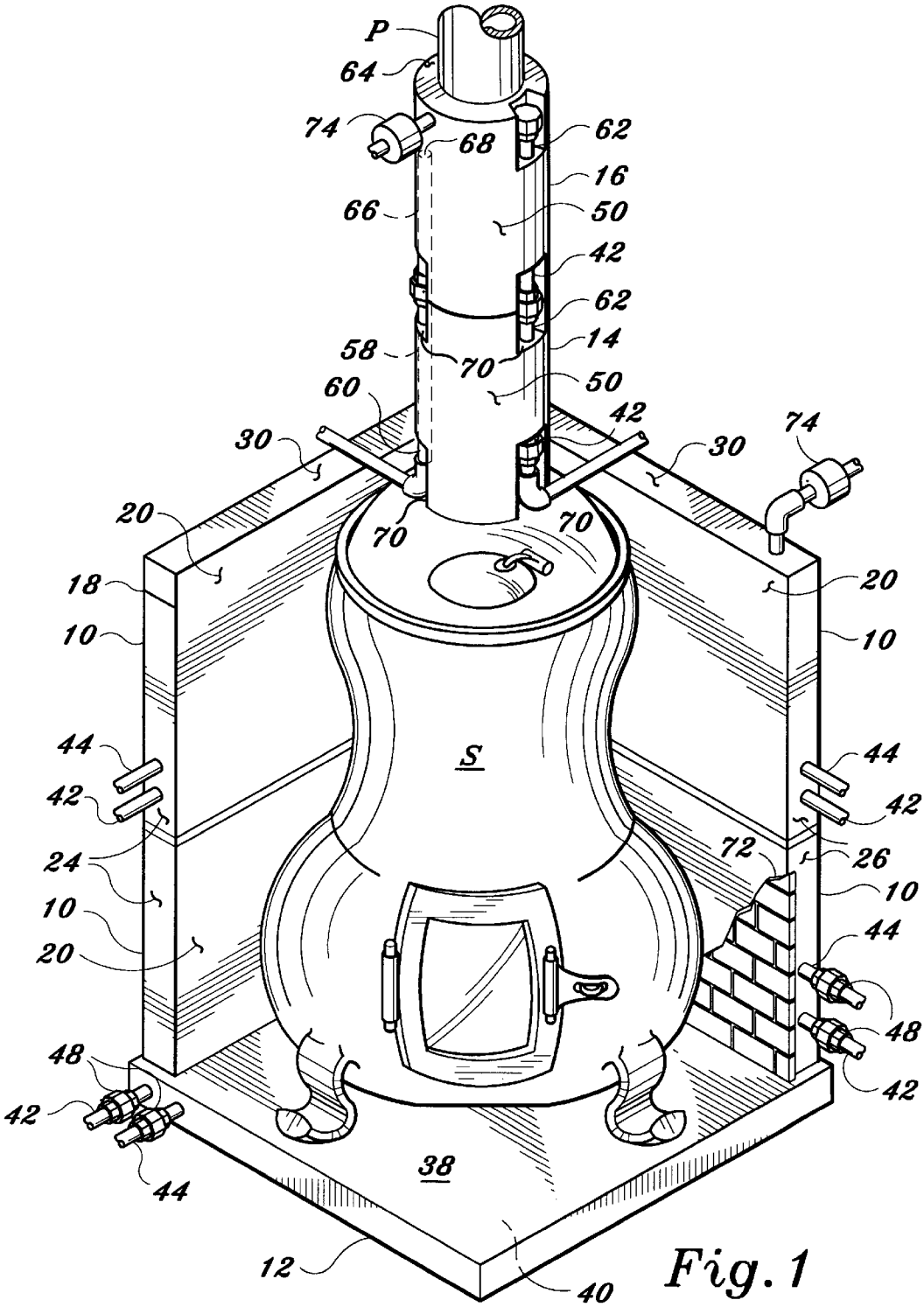
FIG. 1 is a perspective view of a floor panel embodiment and plural wall panel and flue covering panel embodiments of the present thermal protective barrier, installed about a stove to provide insulation between the stove and any nearby structure.

Referring now particularly to FIG. 1 of the drawings, the present invention will be seen to relate to various embodiments of a thermal protective barrier, serving to protect any closely adjacent structural elements from the heat output by a stove or space heater S, or other interior heating unit. The barrier units are each filled with an incombustible liquid, and each may be connected with a water heating system to provide preheating.

The thermal protective barrier embodiments encompass four general types: A wall panel 10, a floor panel 12, and intermediate and upper flue panels 14 and 16. (These flue panels 14/16 are closely related, but differ somewhat in their inlet and outlet lines due to their relative positions.) Each of these thermal protective units is preferably formed as a relatively thin, hollow, closed, water tight structure, of a fireproof material (e. g., galvanized sheet metal, or other suitable material). Preferably, at least the wall panels 10 are formed with a maximum thickness 18 no greater than three and one half inches, in order that they may be permanently built into new construction within the three and one half inch thick wall cavities normally provided by "two by four" stud dimensions. However, these wall panels 10, as well as the other panels 12/14/16, may be constructed to be thicker or thinner, as desired or required for a specific application.

Figure 2:
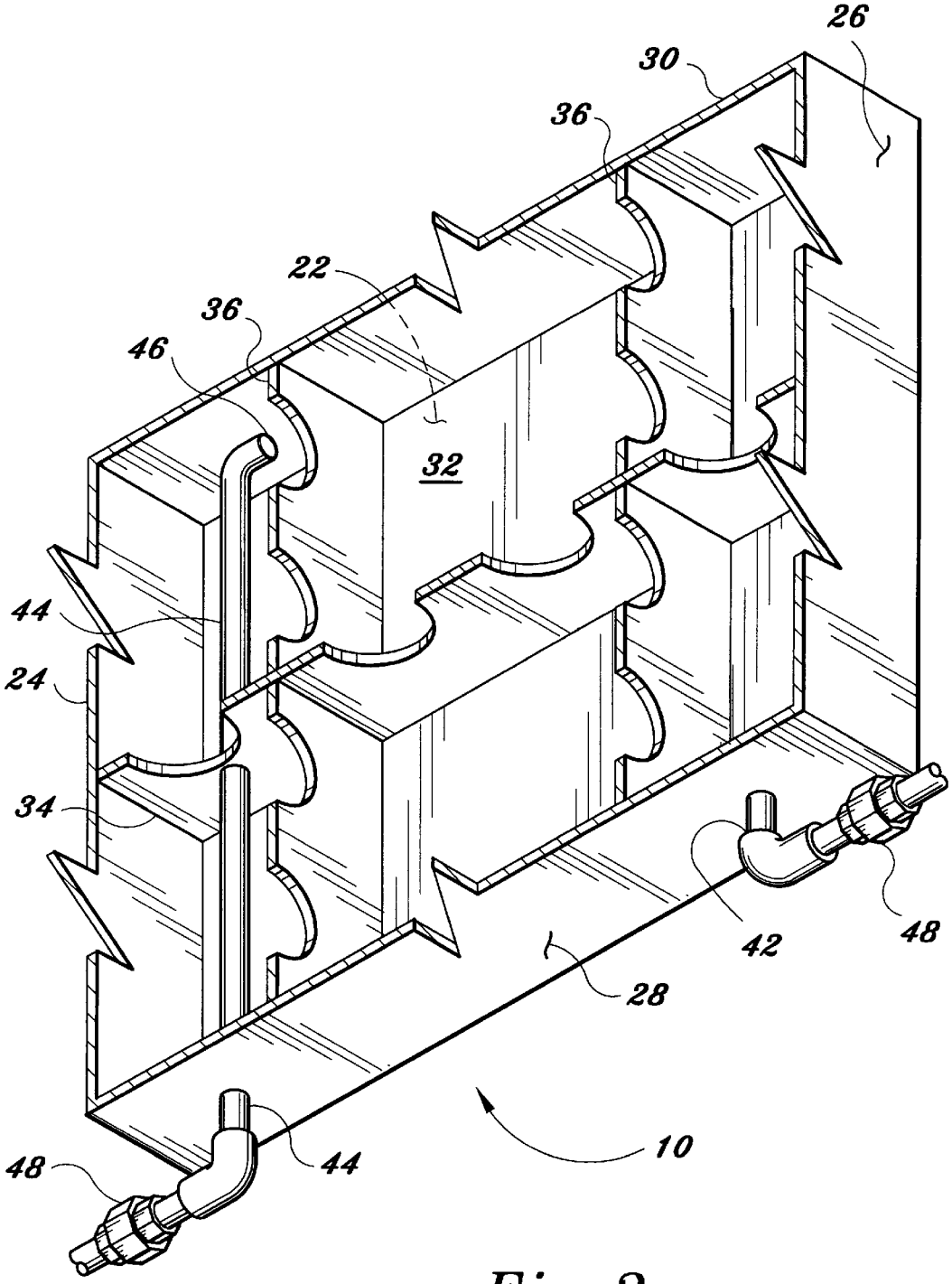
FIG. 2 is a bottom and side perspective view in section of a wall panel embodiment of the present thermal protective barrier, showing internal reinforcement structure installed therein, as well as inlet and outlet fluid lines which may be incorporated therewith.

The general internal structure of a single wall panel 10 is shown in the bottom and side perspective view in section in FIG. 2. (It will be understood that floor panels 12 are similarly configured externally and internally, in order to provide sufficient structure to support the weight of a heavy stove or other heating unit placed thereon.) Each wall panel 10 is formed to have a generally rectangular parallelepiped configuration, with a first face 20 (FIG. 1) and an opposite second face 22, two oppositely disposed edge walls 24 and 26, and two oppositely disposed end walls 28 and 30 providing a continuous interior volume 32 within the panel 10. Each wall panel 10, and particularly each floor panel 12, may include internal reinforcement, such as the open lateral bracing 34 and open vertical bracing 36 shown in FIG. 2.

These braces 34/36 are not baffles, as the panels 10 are fixedly installed and the non-combustible liquid therein is not subject to sudden movement within the panels, but only to slow convective movement or to smooth flow to or through a water heating system, if the panels 10 are so connected. Rather, the braces 34/36 have substantial strength to keep the panel walls from compressively buckling together, particularly the opposite edge walls 24 and 26 if such panels 10 are stacked on edge vertically, as shown in FIG. 1. While the internal structure of a floor panel 12 is not disclosed per se, it will be understood that such internal structure may be substantially similar to the internal structure of the wall panel 10 shown in FIG. 2, and may include additional bracing members 34/36 as required to preclude compressive collapse of the two opposite faces 38 and 40 thereof due to the weight of a stove S or the like being placed thereon.

The present non-combustible liquid filled thermal protective barriers may be used as separate, individual panels, with no fluid interconnection between panels or other liquid heat exchange systems, if desired. If the panels are so used, then only a single liquid inlet valve is required (with perhaps an air bleed outlet). However, the present panels 10/12/14/16 may be interconnected, and/or may be connected to a heat exchange system, if desired, and thus may be provided with more extensive inlet and outlet piping as required for such use. As the present panels 10/12/14/16 will absorb heat which radiates from a stove S to the panels, with the liquid within the panels being heated accordingly, the panels may be used to preheat the domestic water supply prior to entry into a water heating system, and/or may be connected to a building hot water heating system to assist the system, as desired.

FIG. 2 provides a view of the internal piping configuration of such a panel, e. g., a wall panel 10. (It will be understood that a similar configuration may be used for other types of panels.) A liquid inlet port 42 is installed in or near the first or bottom end wall 28, whereby cold liquid may enter the panel 10. A warm liquid outlet port 44 is also provided, with the outlet port having an opening 46 therein communicating with the internal volume 32 of the panel 10, adjacent the second or upper end wall 30.

The precise external arrangement of these ports 42 and 44 is not critical, and may be arranged as desired to connect with other panels 10/12/14/16, and/or to connect to a water heating system of some sort. The critical aspects of the ports 42/44 are that the outlet port 44 be positioned to draw water or other liquid from the uppermost area of the internal volume of the panel, as shown in FIG. 2, in order to take advantage of the convective flow as the warmer liquid rises to the top of the panel. Preferably, the cooler liquid inlet port 42 is located at the bottom of the panel, as shown in FIG. 2. It will be noted that the inlet and outlet ports 42/44 of FIG. 1 enter and exit the wall panels 10 through a side or edge wall 24 or 26, in order to show these ports 42/44 clearly in the drawing figure. Again, they may be arranged in virtually any manner, so long as particularly the outlet port 44, and outlet passage 46 therein, communicates with the uppermost portion of the interior volume of each panel, be it a wall panel 10 or a floor panel 12, and it will be understood that this arrangement is provided in each of the panels 10 and 12 of FIG. 1. Also shown in FIGS. 1 and 2 are pipe unions 48, used to connect each of the inlet and outlet ports 42/44 to one another and to other liquid systems (e. g., shown schematically in FIG. 4).

Figure 3:
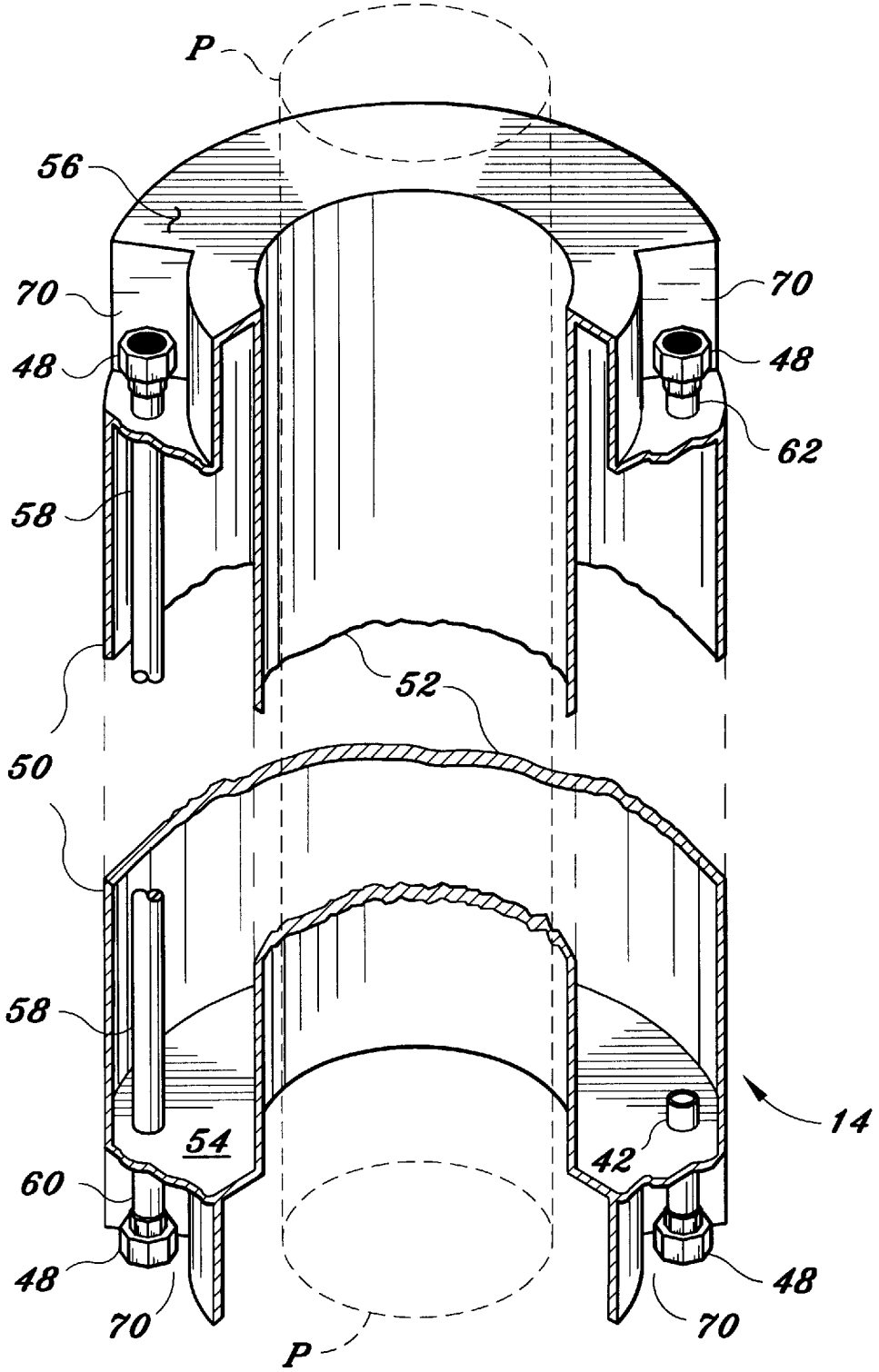
FIG. 3 is a broken perspective view in section of a single base or intermediate flue cover panel embodiment of the present invention, showing details of its construction as well as inlet and outlet fluid lines which may be incorporated therewith.

FIG. 3 provides a view of an alternate embodiment of the present thermal protective barrier, comprising a toroidally shaped panel or sleeve 14, substantially similar to the intermediate panel or sleeve 14 shown in FIG. 1. This panel or sleeve 14 (and the uppermost panel or sleeve 16 of FIG. 1) includes a cylindrical first or outermost face 50, a concentric second or innermost face 52, and a bottom edge or end wall 54 and an opposite top edge or end wall 56. The diameter of the innermost face 52 is such that a flue pipe P may be passed therethrough, with both of the toroidally shaped panels or sleeve 14/16 being adapted for installation about such a flue pipe P stove or heater component.

Each of the flue pipe sleeves 14/16 includes a liquid inlet pipe or port 42, in the manner of the wall and floor panels 10 and 12 discussed further above, which enters the sleeves 14/16 through their bottom end walls 54. This inlet port 42 communicates with the interior volume of the toroidal sleeves 14 and 16, at a point adjacent to the bottom end wall 54, for the same reasons as in the panels 10 and 12 discussed above, i. e., to provide an inlet for relatively cooler and more dense water or other liquid, which will be warmed by heat from the flue pipe P which the sleeves 14/16 surround. A first liquid outlet passage 58 passes through the lower wall 54 and extends upwardly in a continuous, unbroken conduit to pass through the opposite upper wall 56. This outlet passage or pipe 58 is outwardly sealed to each wall 54 and 56, and fluid within the internal volume of the sleeve 14 cannot pass directly to the internal volume of the pipe 58. As the sleeve 14 serves as an intermediate unit, between an underlying like unit or stove S and an overlying like unit or upper sleeve 16, the flow of liquid warmed within the panels 14/16 passes directly from the uppermost sleeve 16 to the outlet end 60 of the outlet passage 58.

As liquid cannot leave the interior volume of the toroidal flue pipe sleeve 14 via the first outlet passage 58, a second outlet port 62 is provided through the upper end wall 56. This second outlet port communicates with the internal volume of the sleeve 14 at a point immediately adjacent the upper end wall 56. Thus, a liquid entering the toroidal sleeve 14, would flow into the interior toroidal volume through the inlet port 42, and essentially fill the interior volume before flowing from the second outlet port 62 and into the next higher toroidal panel unit 14 or 16, as the case may be.

The toroidal sleeve 16 is slightly modified from the panel 14 discussed above, as no flow outward from the top of the sleeve 16 is required. Thus, the second outlet port 62 may be capped, as shown in FIG. 1, or the entire upper end 64 of the sleeve 16 may be simplified by eliminating any additional pipes or plumbing extending therefrom, as indicated on the left side of the upper end wall 64. However, the first outlet passage, indicated as passage 66 in the flue pipe uppermost sleeve 16 of FIG. 1, also does not extend from the upper wall or end 64, but terminates in an opening 68 which communicates with the uppermost portion of the interior volume of the uppermost toroidal sleeve 16. Thus, liquid may flow from the first inlet port 42 of the lowermost toroidal sleeve 14 to fill that sleeve thence outward through the second outlet port 62 to fill the next sleeve 14/16 immediately there above and connected thereto, to eventually fill the uppermost sleeve 16, with liquid returning to the bottom of the stack of sleeves 14/16 by means of the first outlet pipe or passage 66 and its uppermost end opening 68 within the uppermost sleeve 16, thence downward through the first outlet pipes 58 in lower sleeve 14 and out the lowermost outlet end.

It will be seen that the above discussed plumbing and passages may be installed externally to the outermost face 50 of the toroidal sleeves 14/16, if desired. However, such an external installation would require more space for the externally disposed pipes, and would result in a relatively unsightly installation. Accordingly, the present invention provides for internal installation of such pipes, particularly the outlet pipes 58 and 66 respectively of the two toroidal sleeves 14 and 16. Thus, these sleeves 14/16 may include connector access reliefs 70 at each union or other fitting, for the inlet port connections as well as for the outlet port connection(s), as required. It will be noted that such recesses (not shown) may also be provided for the wall and floor panels 10 and 12, discussed further above, if desired.

The above recesses 70 and internal pipe conduits provide a means to "tidy up" the external appearance of the present invention. While the present protective barriers may be installed internally within new construction, as noted above, they also may be readily installed within existing completed structures. Additional appearance enhancement may be provided for such installations by means of a decorative covering or coating 72 applied to the first face 20 of the wall panels 10, shown partially broken away in FIG. 1. (A similar decorative coating, not shown, may also be applied to the upper face 38 of the floor panel 12, if desired.) The pattern may be a brick work design as shown, or may incorporate any one of a virtually unlimited number of different designs, as desired. Preferably, the covering or coating 72 is formed of a heat and fire resistant material, such as formica (tm), or other suitable and durable material.

Normally, it is not anticipated that the thermal protective barriers of the present invention would become excessively overheated, to the point of creating a dangerous overpressure within the panels 12/14/16. However, as a safety measure, a single panel which is interconnected with all other panels, or each separate panel, may be equipped with a relief valve 74, if desired. The relief valve 74 may be in the form of a temperature controlled valve (e.g., automobile engine thermostat) or a pressure controlled valve (e. g., pressure cooker relief valve, etc.), to relieve pressure in the event the liquid within the panel(s) reaches the boiling point.

Figure 4:
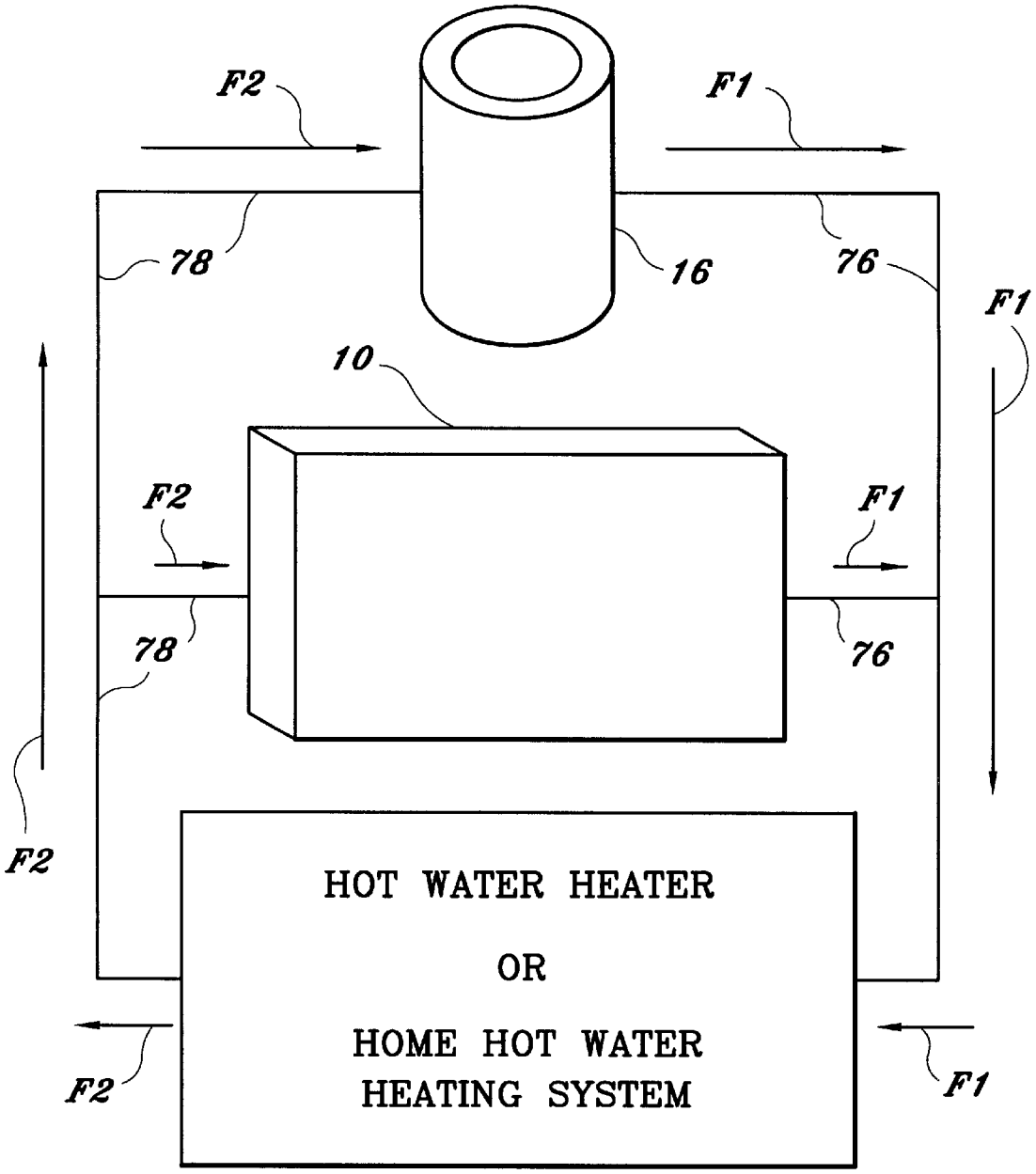
FIG. 4 is a schematic diagram of a wall panel unit and a flue cover unit of the present invention, showing the interconnection thereof with a water heater or hot water heating system.

The above relief valves 74 may be more critical in a system where the panels 10/12/14/16 are not connected to any other liquid heat exchange system, which may have its own relief system. However, the present thermal protective barriers may be connected to such a system (water heater or interior hot water heating system), as shown in FIG. 4. This provides some additional efficiency for such hot water systems, in that some of the latent heat absorbed by the liquid within the panels 10/12/14/16 may be captured by the water heating system. Thus, the wall panel 10 and toroidal flue panel 16, may pass water or other liquid which has been warmed therein, to a water delivery system (indicated as 76 and with the flow arrows F1 in FIG. 4). The incoming water or liquid, being prewarmed to a certain extent, need not be heated to the extent that colder water entering the system from outside, would require, thus saving some energy and expense in the water heating operation.

If the water or other liquid reaches a predetermined temperature which has been established to be lower than the outflow temperature of the heating unit, the liquid may be passed back to the panels 10/12/14/16 by a series of return lines 78. (Normally, hot water from a home water heating system may be drawn off rather than being recirculated, but in the event that hot water needs are not high at any given time, the water may be recirculated as indicated by the recirculation arrows F2, for reheating by the panels 10/12/14/16.)

In summary, the present thermal protective barriers will be seen to provide not only protection from excessive heat from a space heater or the like for nearby structure, but may also serve to capture at least a part of that heat for transfer to a home hot water heating system or water heater, if the panels are interconnected with such heating systems. The result is not only considerable additional safety in the use and operation of stoves, space heaters, and similar devices in the home or other enclosures, but also a potentially significant energy and cost savings through use of the heat energy transferred to the water or liquid within the panels, for the preheating of water or liquid for other purposes.

It is to be understood that the present invention is not limited to the sole embodiments described above, but encompasses any and all embodiments within the scope of the following claims.

I claim:

1. A thermal protective barrier including a panel for installation about an interior space heating unit in combination with a sleeve for installation about a flue component of the interior space heating unit, said sleeve comprising:

a thin, leak proof sleeve formed of a fireproof material and having a cylindrical configuration and a toroidal cross section, said sleeve including an intermediate section and an uppermost section, each said section having an outer face, an opposite inner face, and a lower end and an opposite upper end defining a continuous interior volume therebetween, and containing a non-combustible liquid substantially filling the interior volume of each said section;

said intermediate section including a liquid inlet port communicating with the interior volume of the intermediate section adjacent its lower end, a first outlet passage extending from its lower end to its upper end, said first outlet passage being closed to the interior volume of said intermediate section, and a second outlet passage opposite said first outlet passage, said second outlet passage communicating with the interior volume of said intermediate section adjacent its upper end;

said uppermost section including a liquid inlet port at its lower end connected to said second outlet passage of the intermediate section, and a first outlet passage connected to the first outlet passage of said intermediate section, said first outlet passage of the uppermost section extending from its lower end to adjacent its upper end and providing for separate downward flow of said non-combustible liquid from said uppermost section through said intermediate section;

said panel comprising:

at least one thin, leak proof panel formed of a fireproof material and having a rectangular parallelepiped configuration including a first face and an opposite second face, two oppositely disposed edge walls consisting of a lowermost edge wall and an uppermost edge wall, and two oppositely disposed end walls defining a continuous interior volume therebetween, and containing a non-combustible liquid substantially filling said interior volume;

said at least one panel including a liquid inlet port and a liquid outlet port installed therein, said inlet port communicating with the interior volume immediately adjacent said lowermost edge wall and said outlet port communicating with the interior volume immediately adjacent said uppermost edge wall, with each said port respectively providing for the filling and draining of said non-combustible liquid from said panel, and;

reinforcement means installed within said at least one panel for strengthening said first face and said second face.

2. The thermal protective barrier of claim 1, wherein:

said panel is adapted for vertical placement on one of said edge walls, with said edge walls comprising a lowermost edge wall and an uppermost edge wall, and said inlet port communicates with said interior volume immediately adjacent said lowermost edge wall and said outlet port communicates with said interior volume immediately adjacent said uppermost edge wall.

3. The thermal protective barrier of claim 1, including:

relief means for said non-combustible liquid within said interior volume of said at least one panel, with said relief means being selected from the group comprising temperature controlled valves and pressure controlled valves.

4. The thermal protective barrier of claim 1, wherein:

said at least one panel includes a decorative coating applied to said outer face.

5. The thermal protective barrier of claim 1, wherein:

said inlet port and said at least one liquid outlet passage of said at least one panel are connected with a conventional water heating system.

* * * * *